United States Patent [19]

May

[11] 4,121,493

[45] * Oct. 24, 1978

[54] ADJUSTABLE PITCH DRUM

[76] Inventor: Randall L. May, 7726 Dawnridge, Houston, Tex. 77071

[ * ] Notice: The portion of the term of this patent subsequent to Sep. 20, 1994, has been disclaimed.

[21] Appl. No.: 831,686

[22] Filed: Sep. 8, 1977

Related U.S. Application Data

[63] Continuation-in-part of Ser. No. 731,361, Oct. 12, 1976, Pat. No. 4,048,895.

[51] Int. Cl.[2] ..... G10D 13/02

[52] U.S. Cl. ..... 84/411 A; 84/419

[58] Field of Search ..... 84/411 A, 411 R, 419

[56] References Cited

U.S. PATENT DOCUMENTS

| | | | |
|---|---|---|---|
| 3,818,791 | 6/1974 | Zickos | 84/411 |
| 4,048,895 | 9/1977 | May | 84/411 A |

OTHER PUBLICATIONS

Grove's Dictionary of Music & Musicians, Third Edition, H. C. Colles, Macmillan Co., p. 95.

*Primary Examiner*—L. T. Hix
*Assistant Examiner*—S. D. Schreyer
*Attorney, Agent, or Firm*—Neal J. Mosely

[57] ABSTRACT

An adjustable pitch drum consists of a drum shell of any suitable shape having an open end, a drum head pitch changing mechanism, and a supporting structure mounting the pitch changing mechanism to the drum shell. The pitch changing mechanism consists of a threaded rod adjustably threaded to the supporting structure, a drum head clamping hoop mounted coaxially on the rod for rotation thereabout, and a drum head tensioning hoop non-rotatably mounted on the other end of the rod. Rotation of the drum head and its clamping hoop about the rod varies the tension of the drum head on the tensioning hoop, thereby changing the pitch of the drum. Movement of the threaded rod in the supporting structure changes the spacing of the drum head from the drum shell open end, thereby changing the resonance characteristics of the drum assembly.

10 Claims, 9 Drawing Figures

ADJUSTABLE PITCH DRUM

CROSS REFERENCE TO RELATED APPLICATION

This application is a continuation-in-part of my copending application Ser. No. 731,361, filed Oct. 12, 1976, now U.S. Pat. No. 4,048,895.

BACKGROUND OF THE INVENTION

1. Field of the Invention

This invention relates to new and useful improvements in adjustable pitch drums and more particularly to a separate independently adjustable pitch drum head having a supporting means securing the same on a conventional drum shell of any suitable shape.

2. Brief Description of the Prior Art

A conventional drum consists of a cylindrical drum shell having drum heads held in place by head hoops. Conventional drums are usually not tunable except in a very narrow range by adjustment of the head hoop.

A RotoTom is a recently designed adjustable pitch drum manufactured by Remo, Inc. of North Hollywood, Calif. The RotoTom is in public use and on sale but is not described in any patent or published literature other than a limited amount of advertising literature available from the manufacturer. The RotoTom has a stand and a threaded shaft which extends upward and terminates in an end portion which abuts the head of the drum. The drum consists of a single head mounted on a supporting hoop and supported on a rigid multi-legged spider support. The spider is secured on a threaded tubular support which rides on the threaded shaft. Rotation of the supporting hoop by the drummer causes the threaded support to move upward and downward on the threaded shaft and vary the tensioning force against the drum head to tune the same. The RotoTom does not have the appearance of a conventional drum and has encountered some customer resistance. In addition, the RotoTom, while adjustable in pitch, does not have the tone effects provided by the shell of a conventional drum.

SUMMARY OF THE INVENTION

This invention comprises a new and improved drum assembly consisting of a RotoTom coupled to a conventional drum shell of any suitable shape and supporting means for supporting the RotoTom on such shell.

It is an object of this invention to provide a new and improved adjustable pitch drum.

Another object of this invention is to provide an improved supporting structure for mounting an adjustable pitch independently adjustable drum head on a drum shell.

A feature of this invention is the provision of an independently adjustable drum head, known as a RotoTom, coupled by an adjustable support to a drum shell.

Another feathre of this invention is an improved supporting spider and adjustable shaft arrangement for supporting an independently adjustable drum head on a drum shell.

Other objects and features of this invention will become apparent from time to time throughout the specification and claims as hereinafter related.

DESCRIPTION OF THE PREFERRED EMBODIMENT

Figure 1:
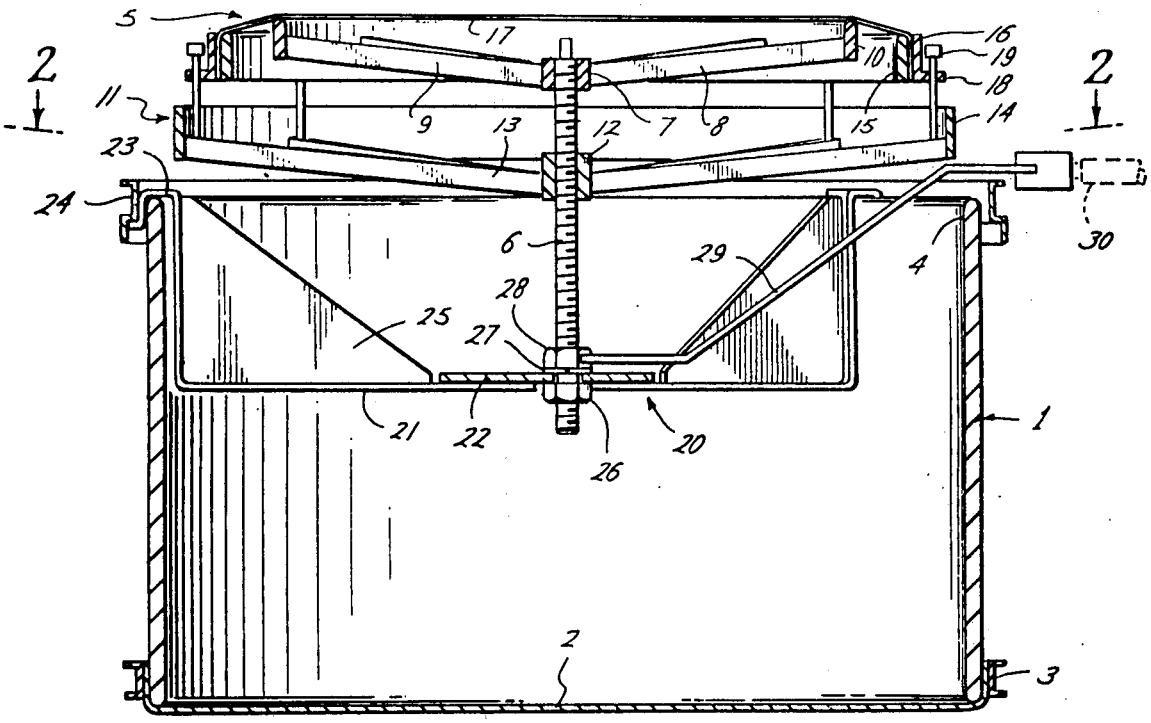
FIG. 1 is a view taken on the line 1—1 of FIG. 2 illustrating in partial section an improved adjustable pitch drum.

In the drawings, there is shown a combination of an adjustable pitch drum with a conventional drum shell. the combination results in the advantages of adjustable pitch and the tone afforded by a conventional drum shell, together with the appearance of a conventional drum. In FIG. 1 the combination is shown including a conventional drum shell 1 having a lower drum head 2 held in place by a conventional drum hoop 3. The upper end of the drum is open and does not have the conventional drum head stretched thereon.

At the open end 4 of drum shell 1 there is supported an adjustable pitch drum structure, generally designated 5 of the type known as a RotoTom.

The RotoTom 5 consists of a threaded rod 6 which carries a tensioning spider at its upper end comprising the central support 7 having a plurality of legs 8 and 9 which extend to and are integral with a tensioning hoop 10. The tensioning spider is held in a fixed position at the end of supporting rod 6.

A second spider 11 is supported on rod 6 and consists of a central threaded hub 12 having a plurality of supporting arms 13 extending outward to and being integral with a first supporting hoop 14. A second supporting hoop 15 is spaced from spider 11 and fits inside clamping hoop 16. Hoops 15 and 16 secure the periphery of drum head 17 tightly. Hoop 16 has a lower flange 18 through which extend a plurality of bolts 19 which are threadedly mounted in bosses on supporting hoop 14 of spider 11.

Hoop 14 may be rotated to turn support 12 on threaded shaft 6 to vary the position of spider 11 relative to the tensioning hoop 10. Tensioning hoop 10 is maintained in a position abutting the drum head 17 and rotation of supporting hoop 14 moves the same on shaft 6 to adjust the tension of the drum head for tuning. This adjustment is operable to tune over a range of up to several octaves. The structure, so far described, is that of a commercially available RotoTom.

Figure 2:
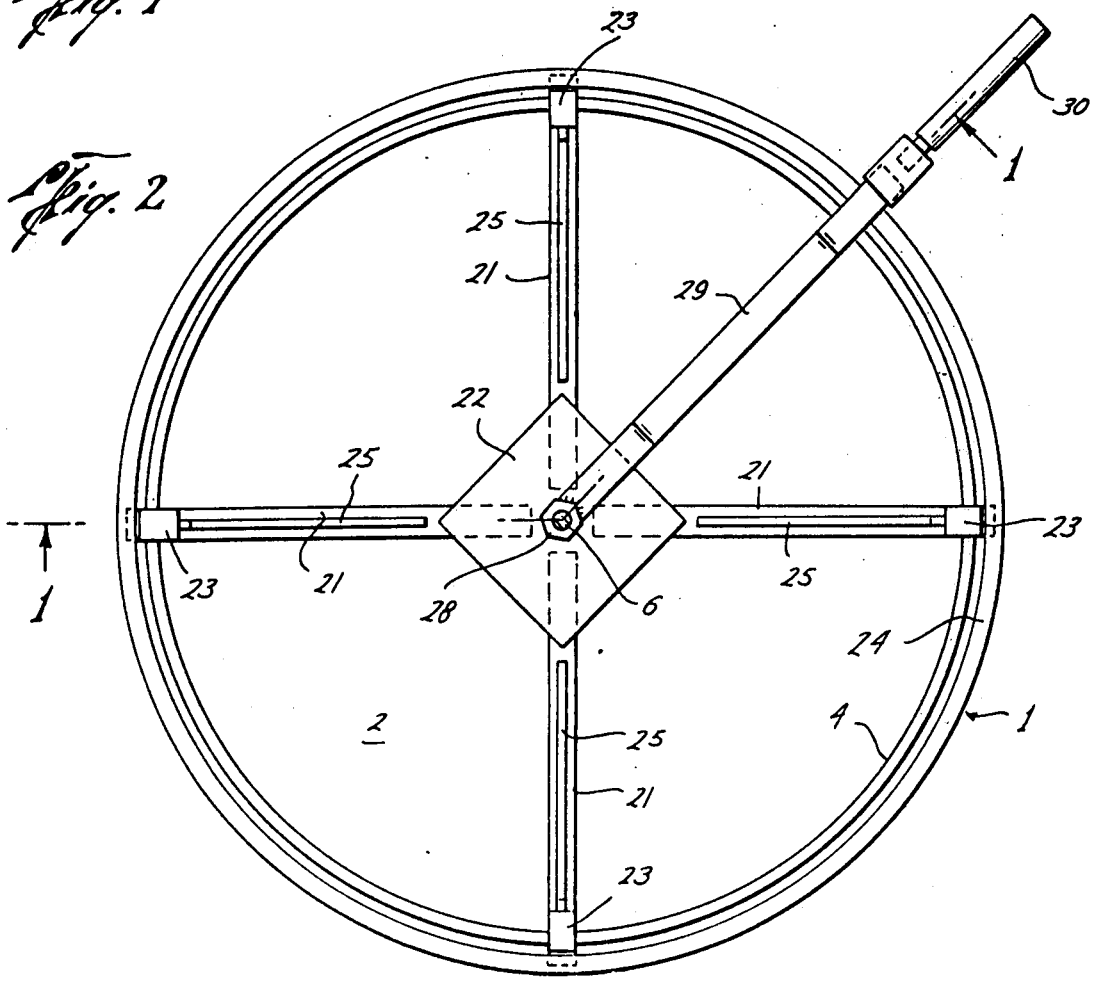
FIG. 2 is a plan view, partly in section, taken on the line 2—2 of FIG. 1, illustrating a drum shell and supporting spider for adjustably supporting an adjustable drum head on said shell.

In this apparatus there is provided a supporting spider 20 having a plurality of legs 21 secured in a fixed position to supporting plate 22. The legs 21 are rebent at their respective upper ends as indicated at 23 to provide a supporting rim fitting over the open end 4 of drum shell 1 and held in position by drum hoop 24. The supporting legs 21 are made rigid by bracing flanges 25 which are formed integrally therewith. In the embodiment illustrated in FIGS. 1 and 2, there are provided four of the supporting arms 21 spaced equally around the drum shell 1.

Supporting plate 22 has a nut 26 secured on the lower surface thereof as by welding or brasing. Nut 26 provides a fixed threaded support for shaft 6 of the RotoTom. On the upper side of the assembled support is provided a lock washer 27 and locking nut 28 having an operating level 29 terminating in a handle 30.

When the apparatus is assembled, the support spider 20 is placed over the open end 4 of drum shell 1 and held in place by drum hoop 24. Next, the shaft or supporting rod 6 of the RotoTom has the locking screw 28 threaded thereon and lock washer placed in position. The shaft or supporting rod 6 is then threaded into supporting nut 26 on the support spider 20. The RotoTom shaft or supporting rod 6 is threaded into nut 26 to the desired positon relative to drum shell 1 and handle 30 is used to rotate lever 29 to rotate nut 28 until it is compressed against lock washer 27 and secures the shaft in a fixed position. The spider may have legs which are adjustable in length as in my copending application Ser. No. 831,671, filed Sept. 8, 1977.

When the drum is assembled in this manner it has the appearance of a conventional drum but provides the action and tone of a RotoTom. Supporting hoop 14 may be rotated to vary the pitch of drum head 17 and can provide tuning over a wide range. When lever 29 is moved to rotate nut 28 and release shaft or supporting rod 6 for movement, rotation of supporting hoop 14 will cause shaft or rod 6 to be threaded into or out of supporting nut 26. This will cause the RotoTom to be moved upwardly or downwardly relative to the open end 4 of drum shell 1 and provide an additional variation in tone. The movement of the RotoTom relative to the open end of drum shell 1 provides for variation in resonant tone as well as the tuning which may be effected by rotation of the RotoTom on its supporting shaft or rod 6. When the RotoTom is positioned relative to supporting spider 20 at a point providing the desired resonant tone, lever 29 is operated to rotate locking nut 28 to lock the shaft or rod 6 in a fixed position.

Figure 3:
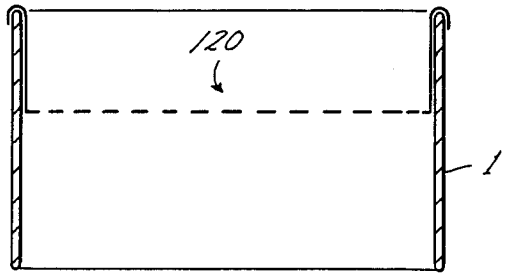
FIG. 3 is a view, partially schematic, in section, showing an embodiment of this invention in which the drum shell has no bottom drum head.

In FIG. 3, the invention is illustrated with hollow drum shell 1 having no bottom drum head. The supporting spider is shown schematically as 120.

Figure 4:
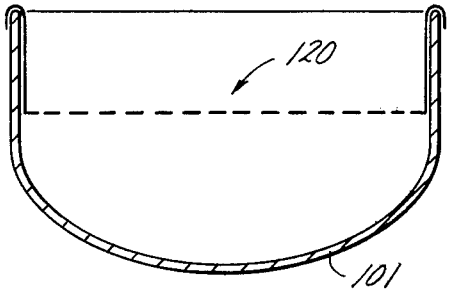
FIG. 4 is a view illustrating the invention as applied to a timpani drum shell.
Figure 5:
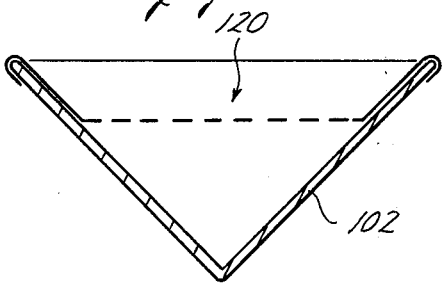
FIG. 5 is a view illustrating the invention as applied to a conical drum shell.
Figure 6:
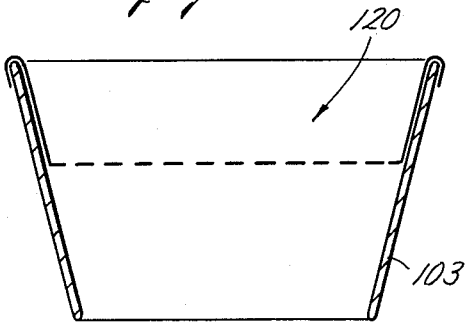
FIG. 6 is a view illustrating the invention as applied to the large end of a frusto-conical drum shell.
Figure 7:
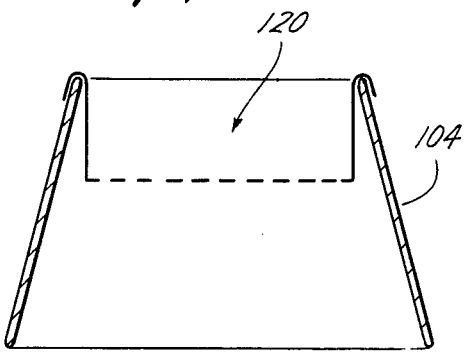
FIG. 7 is a view illustrating the invention as applied to the small end of a frusto-conical drum shell.
Figure 8:
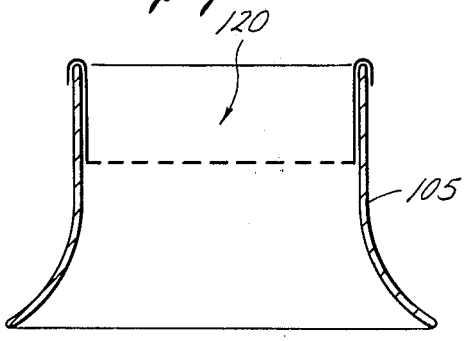
FIG. 8 is a view illustrating the invention as applied to a drum shell having a flared lower end.
Figure 9:
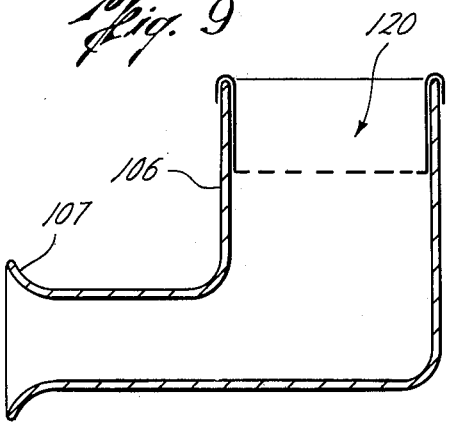
FIG. 9 is a view illustrating the invention as applied to a drum shell having a flared end extending at a right angle to the axis of the drum.

In FIGS. 4 to 9, the invention is illustrated with the supporting spider 120 applied to a variety of drum shapes. In FIG. 4 the RotoTom is coupled to a timpani drum 101 by spider 120. In FIG. 5, the RotoTom is coupled to a drum shell 102 of conical shape. In FIG. 6, the RotoTom is coupled to the large end of a frusto-conical drum shell 103. In FIG. 7, the RotoTom is coupled to the small end of a frusto-conical drum shell 104. In FIG. 8, the RotoTom is coupled to a drum shell 105 which is flared outward at its lower end. In FIG. 9, the RotoTom is coupled to a drum shell 106 which has a flared end portion 107 extending at a right angle to the axis of the drum. In any of these various applications of the invention, except for FIGS. 4 and 5, the bottom end may be open as in FIG. 3 or provided with a fixed drum head as in FIG. 1 or an adjustable drum head tuning means as applied at the top end. While there have been shown a variety of drum shapes supporting a RotoTom it should be understood that these are only illustrative of the invention and any other hollow drum shell of suitable shape may be used.

I claim:

1. An adjustable musical drum assembly comprising a threaded supporting rod, drum head tuning means comprising a drum head mounted on supporting means rotatably threaded on said rod and tension means non-rotatably mounted on one end of said rod, said drum head being stretched over said tension means, whereby rotation of said drum head supporting means varies the tension of the drum head to tune the same, a hollow drum shell having an open end, and means operatively securing said drum shell open end to said drum head tuning means.

2. A drum assembly according to claim 1 in which said hollow drum shell has a closed end opposite said open end.

3. A drum assembly according to claim 2 in which said hollow drum shell is a timpani drum shell.

4. A drum assembly according to claim 2 in which said hollow drum shell is conical in shape.

5. A drum assembly according to claim 2 in which said hollow drum shell has a drum head closing the end opposite said open end.

6. A drum assembly according to claim 1 in which said hollow drum shell is frusto-conical in shape.

7. A drum assembly according to claim 1 in which said hollow drum shell has an outwardly flared end opposite said open end.

8. A drum assembly according to claim 1 in which said securing means is secured to the end opposite said one end of said threaded rod and said rod and supporting means are relatively adjustable to vary the spacing of said drum head from said shell open end.

9. A drum assembly according to claim 8 in which said drum shell has a closed end opposite said open end.

10. A drum assembly according to claim 8 in which said drum shell is non-cylindrical in shape.

* * * * *